United States Patent [19]

Coppens et al.

[11] Patent Number: 4,677,033

[45] Date of Patent: Jun. 30, 1987

[54] TERNARY BRASS ALLOY COATED STEEL ELEMENTS FOR REINFORCING RUBBER

[76] Inventors: Wilfried Coppens, C. Verschaevestraat 7, B-8510 Kortrijk; Hugo Lievens, Coupure 403, B-9000 Gent, both of Belgium

[21] Appl. No.: 811,273

[22] Filed: Dec. 20, 1985

[30] Foreign Application Priority Data

Jan. 7, 1985 [GB] United Kingdom ..... 8500322

[51] Int. Cl.[4] ..... B32B 15/06; B60C 9/00

[52] U.S. Cl. ..... 428/677; 428/941; 152/565

[58] Field of Search ..... 428/592, 677, 676, 624, 428/625, 626, 610, 941; 57/217, 902; 152/451, 565, 527; 420/482

[56] References Cited

U.S. PATENT DOCUMENTS

| | | | |
|---|---|---|---|
| 3,385,697 | 5/1968 | Kabelka | 420/482 |
| 3,858,635 | 1/1975 | Nakamoto et al. | 57/902 |
| 4,218,517 | 8/1980 | Van Ooij | 428/677 |
| 4,255,496 | 3/1981 | Haemers | 428/676 |
| 4,446,198 | 5/1984 | Shemenski et al. | 428/677 |

FOREIGN PATENT DOCUMENTS

| | | | |
|---|---|---|---|
| 47-26320 | 3/1972 | Japan . | |
| 47-26318 | 4/1972 | Japan . | |
| 133362 | 10/1919 | United Kingdom | 420/482 |
| 598112 | 2/1948 | United Kingdom | 420/482 |

OTHER PUBLICATIONS

"The Ternary System, Copper-Manganese-Zinc", Graham et al., Metals Transactions, vol. 185, Oct. 1949, pp. 675-682.

W. J. von Ool J, Fundamental Aspects of Rubber Adhesion to Brass-Plated Steel Tire Cords, 1979, Rubber Chemistry and Technology, vol. 52, No. 3, pp. 651-669.

*Primary Examiner*—L. Dewayne Rutledge
*Assistant Examiner*—John J. Zimmerman
*Attorney, Agent, or Firm*—Shlesinger, Arkwright, Garvey & Fado

[57] ABSTRACT

A steel reinforcing element for vulcanized rubber articles having a thermodiffused alloy coating consisting of from about 59.3% to about 70.7% copper, from about 0.2% to 10.4% manganese and with the balance being zinc.

19 Claims, No Drawings

TERNARY BRASS ALLOY COATED STEEL ELEMENTS FOR REINFORCING RUBBER

BACKGROUND OF THE INVENTION

This invention relates to steel reinforcing elements, such as wire, cord, cable and the like, for elastomeric composite materials. More particularly, the invention relates to steel wire for being embedded in a rubber material vulcanizable with sulphur to obtain a reinforced rubber article, such as e.g. a vehicle tire. The wire is covered with a thin coating of brass to improve the bonding with the rubber compound during the vulcanization process. The present invention also extends to reinforcing cable and cord made from the coated steel wires, as well as rubber products reinforced therewith, and particularly pneumatic tires for vehicles.

Steel wires and like products are now generally used for strengthening a variety of rubber products, including tires, conveyor belts, hoses and the like. Such a reinforcing element can be a monofilament, but it is normally prepared from several filaments which are twisted together to form a strand. The strand of filaments can be further assembled to form a steel tire cord, a belt cord, a cable, a weft of wires and/or cords and other combinations. Such reinforcing elements are usually comprised of brass plated high-carbon steel wire having a diameter of up to 2 mm, mostly from 0.05 to 0,50 mm for tire cord, and may have a carbon content of 0.40 to 1.40%, and preferably 0.60 to 1.0% C.

In the automobile tire manufacturing industry, for instance, large scale use is made of the reinforcement of rubber with steel cord made from a number of 0.70% carbon steel wires in a diameter range of 0.10 to 0.40 mm, the wires being covered with a thin rubber adherent brass coating. These steel cords are first brought into contact with unvulcanized rubber. Subsequently the rubber is subjected to a vulcanization treatment during which the adhesion between rubber and brass is effected.

It is generally known that a brass composition, containing from 55 to 75% Cu (the remainder being essentially zinc), and preferably from 60 to 72% Cu, is suitable for attaining a reasonable adhesion level. However, in order for rubber articles which are reinforced with brass-coated steel wire or cord to function effectively, it is imperative that good adhesion between the rubber and the brass be maintained during the lifetime of the article and under all circumstances.

In this respect, it is recognized that the conditions to which automobile tires, for example, may be subjected are so demanding (e.g. high dynamic loads, humidity, salt corrosion, heat ageing, etc.) that the required adhesion retention between the steel cord and the rubber is not always satisfactorily met by known brass-coated cords.

With regard to the adhesion between a brass-coated wire and rubber, a distinction should be made between the initial adhesion level and adhesion strength after ageing, i.e. after humidity, corrosion and temperature effects occurring during the running life of a tire, for instance.

Initial adhesion is, in general, determined by measuring the force (by means of a tensile tester) required to pull out the rubberized cords, the cords having been bonded by vulcanization to a given rubber. The pull-out force is expressed in Newtons (this being the test procedure for the adhesion of tire cord according to ASTM D 2229-80).

The effect of ageing in service can be simulated by subjecting the vulcanized cord samples to an ageing treatment in a moist atmosphere or in a steam atmosphere at a prescribed temperature for a variable time. After this treatment the actual adhesion level can be evaluated by measuring the bond strength by means of a cord pull-out test carried out on a tensile tester, as described above, or by measuring the rubber coverage of the cords which have been separated from the rubber sample (either complete or partial separation depending on the type of test).

For the purpose of illustrating the effect of ageing on the residual adhesion strength, we chose the following test conditions: namely, in a humidity aged adhesion test, a vulcanized rubber cord sample was treated for a variable time at 70° C. in an atmosphere of 95% relative humidity, and in a steam ageing test, a vulcanized cord sample was kept in a steam atmosphere at 120° C. After these ageing treatments the adhesion force was measured on the tensile tester (cord pull-out test according to ASTM 2229-80).

The quality of the adhesion of the reinforcing elements to the rubber is also indicated by the degree of rubber coverage. This is the amount of rubber left on the reinforcing wire or cord after it is pulled out or otherwise separated from the vulcanized rubber matrix, such as e.g. by a peel test or by a strip separation test. We used the strip test. The amount of rubber-coverage was then evaluated visually and was expressed as an appearance ratio index on a scale ranging from 0 to 10, whereby index 0 refers to zero coverage and index 10 refers to full rubber coverage, or on a scale of from 1 to 5 (under 5 referring to 100% coverage and index 1 referring to less than 40% coverage). A high rubber coverage is indicative of excellent adhesion between rubber and cord and preserves the reinforced rubber product by preventing possible ply or cord separation.

From such adhesion measurements on known brass-coated steel reinforcing elements it has been found that the adhesion after ageing, i.e. after cured humidity ageing and after steam ageing, will often be considerably reduced and may actually become more than 50% lower than the initial adhesion. The decrease partly depends on the rubber composition used, but mostly on the brass coating and its intrinsic capacity to retain adhesion strength and rubber coverage in ageing conditions.

OBJECTS AND SUMMARY OF THE INVENTION

It is an object of the invention to provide a reinforcing element with improved adhesion retention after ageing.

According to the invention, a steel reinforcing element for use in sulphur containing vulcaniizable rubber is covered with a thin rubber adherent brass alloy coating comprising 0.01 to 15% by weight of manganese.

It is preferred that the alloy contain 0.05 to 15% of manganese and more preferably from 0.1 to 6% when the ternary element is homogeneously distributed in the brass composition over the coating thickness. Alternatively, it is preferred that the alloy should contain from 0.01 to 5% of manganese or more preferably from 0.02 to 2% calculated on the coating weight, when the manganese is essentially concentrated in the outer surface layer of the brass coating, whereby the surface layer comprises less than about one third of the toal brass coating thickness.

DESCRIPTION OF THE INVENTION

Generally preferable alloy compositions are those which, besides zinc, contain 50 to 75% by weight of copper and 0.01 to 15% and preferably 0.05 to 10, or more preferably 0.1 to 5% of manganese. In particular, it is most preferred that the alloy should comprise about 55 to 72% by weight of copper, 0.02 to 6% Mn, the remaining being zinc and incidental impurities.

The alloy coating is preferably a ternary alloy of copper, zinc and manganese and the layer thickness is in the range of 0.05 to 0.50 μm, for example 0.08 to 0.4 μm. This layer can be present on wires having a tensile strength exceeding 2500 $N/mm^2$, and having a final diameter in the range of 0.05 to 2 mm. When the Mn-brass alloy coated wires are hard drawn to their final dimension, such as e.g. for reinforcing hoses, tires and belts, the preferred wire diameters may range from 0.10 to 1 mm, and more preferably from 0.1 to 0.5 mm. The invention also comprises articles formed from a rubber material reinforced with steel elements, such as e.g. pneumatic tires for vehicles, which steel elements are formed from the steel wires coated with the copper-zinc-manganese alloy of the invention. The coated steel wire and the reinforcing strand, cable or cord made therefrom according to the invention, are particularly suitable for use in pneumatic tires, and more particularly in the carcass, tread and/or belt of vehicle tires, but their field of application may also include hoses and conveyor transmission and timing belts.

A process for the manufacture of steel wire provided with the required alloy coating which wire can be used, generally after being formed into a strand, cord, cable, mat or weft, for reinforcing an article of rubber material after having been bonded to it during vulcanization, is described hereinbelow.

A coated wire according to this invention can be manufactured by coating the wire surface with a Cu-Zn-Mn alloy of suitable composition and thickness, either when the wire is at a final diameter (i.e. after completion of a drawing process) or at an intermediate heat treated size which is then further drawn to the desired final size and subsequently twisted into a steel cord.

A common method for applying a brass alloy coating to a wire substrate comprises the steps of electrodepositing a copper layer on a heat treated and pickled wire by passsing the wire through an electrolytic bath containing a Cu-plating solution (such as e.g. a Cu-sulphate bath or a Cu-pyrophosphate bath), then plating onto the copper layer a layer of zinc by passing the already coppered wire through an electrolytic Zn-sulphate bath, and finally subjecting the double coated wire to a heating treatment for a few seconds at about 550° C., during which the copper and zinc diffuse into each other to form a homogeneous brass alloy.

Numerous methods can be employed to coat steel reinforcing elements with ternary manganese-brass alloys. One method of producing the coatings is to pass the steel substrate through a molten bath of a ternary manganese-brass alloy. A more convenient method for applying the ternary Mn-Cu-Zn alloy onto steel elements is by electroplating. A number of processes can be employed to electrodeposit the required alloy coating.

One possible method is to make use of the alloy plating technique, whereby the required alloy coating is obtained by passing the steel element through an electrochemical alloy plating bath containing the elements Mn, Cu and Zn in the right amounts in the solution, as required for the codeposition of the required alloy composition.

Another possible method is partial alloy plating, whereby first a binary alloy layer of Cu-Zn, Cu-Mn or Mn-Zn is electrodeposited onto the steel substrate, followed by plating thereon of a second layer of the appropriate third element. The ternary alloy is then formed by subjecting the plated substrate to a diffusion heating treatment during which the third element mixes with the binary alloy of the first layer, so as to form a diffused ternary alloy. In this process the plating sequence may also be reversed, i.e. first plating a single metal layer and then a second layer of a binary alloy, fiollowed by thermodiffusion of the deposit.

A simple and more practical method for applying the ternary copper-zinc-manganese alloy coating is to make use of the sequential electroplating technique, whereby the constituting alloy elements Clu, Zn and Mn are electrodeposited as three distinct metal layers, which are then thermodiffused to form a ternary alloy. The plating sequence can be chosen at will, but it is recommended—as in conventional brass diffusion coating—to start with a copper electrodeposit as the first metal layer. The manganese layer can be plated between the electrodeposited copper and zinc layer, or on top of the previously plated Cu and Zn layers, before subjecting the plated element to thermodiffusion heating.

Numerous plating baths can be employed for electrodepositing copper and zinc. Copper plating can be carried out by using an alkaline cyanide electrolyte or a pyrophosphate bath, an acid sulphate bath and also a fast sulfamate or fluoroborate bath.

Zinc can be electrodeposited from an alkaline cyanide bath, from acid zinc solutions including sulphate electrolytes and ammonium/chloride electrolytes, and also from high rate deposition baths, such as e.g. fluoraborate and sulfamates. In practice, sulphate electrolytes (Cu and Zn) and pyrophosphate baths (Cu) are the most common for plating wires. A copper plating bath, for example, contains about 200 g/l potassium pyrophosphate and 10 to 40 g/l of copper (II)—pyrophosphate. The pH is maintained at a value of about 9 and bath temperature at about 50° C. A typical zinc plating bath may contain an aqueous solution of about 150–300 g/l zinc sulphate ($ZnSO_4$ $0.7H_2O$) and a smaller amount of ammonium chloride (up to 30 g/l) and/or boric acid (up to 20 g/l), and is operated in a pH range of 3 to 4.5 (addition of sulphuric acid) at room temperature.

By varying the plating parameters, i.e. time, immersion length and current density, any required amount of copper and zinc can be electrodeposited onto the steel substrate.

Manganese plating is much less common and for this reason there is little knowledge of satisfactory plating solutions. Manganese can be plated from chloride and sulphate electrolytes (see e.g. Journal of Applied Electrochemistry 4 (1974), page 317/321 or U.S. Pat. No. 3,696,011), and also from fluoroborate and sulfamate solutions. A sulfamate bath, for example, may contain 70 g/l of manganese sulfamate and 40 g/l boric acid. Operating conditions are pH 3.5–4 and temperature of 50° C.

To illustrate a process of plating manganese a manganese sulphate bath is used. The bath composition comprises about 100 g/l of Mn-sulphate, 20 to 60 g/l ammoniumrhodanid, and 10 to 20 g/l boric acid or 50 to 75 g/l ammoniumsulphate. The pH of the electrolyte is regulated at a level of 4 to 5.5 and the bath temperature is maintained at about 40° C. Current density may be up to 30 A/dm$^2$. From such an electrolyte a metallic layer of manganese is electroplated.

As already mentioned above, different modes of preparing the Cu-Zn-Mn alloy coating are possible, in particular with respect to the plating sequence (Mn layer between Cu and Zn layer or on top of a double Cu and Zn-layer) and with respect to the execution and conditions of the thermodiffusion treatment. It is most convenient to carry out the sequential plating of Cu, Zn and Mn (Cu/Mn/Zn or Cu/Zn/Mn) on a heat treated steel element, for example a patented wire. The resulting wire has a 3-layer Cu-Mn-Zn or Cu-Zn-Mn-coating on its surface, whereby the 3 distinct layers are present in the proportion of thickness or weight that is desired for them to represent the ternary Cu-Zn-Mn alloy. The coated wire substrate is then heat treated (by any heating method) at a temperature of about 500°-600° C. so as to form a diffused ternary manganese brass coating on the wire surface. Depending on plating and thermodiffusion conditions, the obtained Mn-brass alloy coating is homogeneous in manganese content or may contain a Mn-concentration gradient. The alloy coating variants are all within the scope of the present invention, provided the average Mn-content is within the compositional limits according to this specification.

When the coated steel elements are intended for steel cord aplications, e.g. for use in vehicle tires, the Mn-brass diffusion coating can be achieved in principle by following a manufacturing sequence which departs from the normal processing sequence (electrolytic Cu and Zn deposition, diffusion heating to brass, drawing of brassed wire, cord making) used in preparing cords plated with a conventional brass diffusion coating.

Alternative manufacturing methods to obtain a ternary Mn-brass alloy coated wire material in accordance with the present invention include:

1. covering a patented wire with a conventional brass (alloy plated or diffused) coating, wire drawing and cord making, plating the brassed wire with a required amount of manganese, diffusion treatment of the finished cord.

2. Electrolytic deposition of Cu, Zn and Mn as 3 distinct layers on a patented wire, wire drawing to intermediate or final diameter, diffusion heating of the 3 layers to a Mn-brass alloy either on intermediate or final wire diameter, or on the finished cord.

The invention will be further described with reference to a few illustrative embodiments.

In a first series of examples, a patented and chemically cleaned wire of 0.70% carbon steel, having a diameter of 1.20 mm, was passed successively through electrochemical copper, manganese and zinc plating baths, the plating baths being prepared from a sulphate electrolyte as described hereinabove. After plating and thermodiffusion (570° C.-4 seconds), a Mn-brass alloy was obtained having a thickness of 1.20 μm. By adjusting the deposition conditions in each bath, a number of alloy compositions of the Cu-Zn-Mn coating were produced, which are detailed in the test results described below. The coated wires were then drawn to a diameter of 0.25 mm, and a tensile strength of greater than 2800 N/mm$^2$ and twisted to a 4×0.25 mm type cord.

Adhesion tests were carried out on rubberized and vulcanized cords. The rubber material of the vulcanized cord samples refers to different rubber mixtures which are commonly used by various firms for the manufacture of automobile tires. The composition of the rubber compounds, employed in the examples, is summarized in table 1.

TABLE 1

Basic constituents of investigated rubber compounds (in weight parts)

| Constituents | Compound A | B | C | D |
|---|---|---|---|---|
| softeners & volatile substances | 7.5 | 8 | 8 | 8 |
| rubber polymers | 54.5 | 52 | 50.5 | 53.5 |
| carbon black | 26.5 | 34 | 37 | 28 |
| ash content | 11.5 | 6 | 4.5 | 10.5 |
| sulphur | 2.50 | 2.70 | 2.90 | 2.35 |

In the above table the first four components add up to 100 parts and the sulphur content is expressed as an addition.

EXAMPLE 1

Type A rubber was combined with conventional brassed cords and with Mn-brass alloy plated cords of the present invention to assess rubber to cord adhesion, after vulcanization (initial adhesion) and after vulcanization and humidity curing (humidity aged adhesion), respectively. Rubber strip samples containing 4×0.25 mm cords were vulcanized at 160° C. for 30 minutes. To assess the effect of humidity ageing, the vulcanized samples were subjected to a postcuring cycle at 70° C. in an atmosphere of 95% relative humidity for 7 days. A strip test sample contained 2 cord/rubber laminates pressed together, whereby each laminate consisted of 2 rubber sheets covering one layer of parallel cords (simulating a cord/rubber ply). The 2 plies were laminated together and vulcanized. The strip adhesion test involved tearing apart the two laminates so as to expose the embedded cords and measuring the percentage of their rubber coverage. This was expressed as an arbitrary appearance ratio of from 1 to 5. On this scale, index 5 corresponds to 100% rubber coverage (max. adhesion) and index 1 to less than 40% coverage (poor adhesion). The strip test was carried out after vulcanization (initial adhesion level) and after vulcanization and humidity ageing (cured humidity adhesion).

In table 2 the strip test adhesion results are summarized for a number of conventional cords in comparison with cords of this invention.

TABLE 2

Appearance ratio for initial adhesion and aged humidity adhesion of cords vulcanized with Type A rubber.

| Cord samples 4 × 0.25 mm | Initial adhesion | Cured humidity (7 days - 70° C. - 95% rel. humidity) |
|---|---|---|
| Conventional brass diffusion coating | | |
| 0.25 μm/65 Cu—35 Zn | 4.75 | 1 |
| 0.25 μm/70 Cu—30 Zn | 4.50 | 1 |
| 0.25 μm/61 Cu—39 Zn | 4 | 1 |
| Mn—brass Alloy coating | | |
| 0.25 μm/63.5 Cu—2.5 Mn—34 Zn | 5 | 2.5 |
| 0.25 μm/68.9 Cu—3.1 Mn—28 Zn | 4.25 | 2.0 |
| 0.25 μm/59.3 Cu—2.9 Mn—37 Zn | 5 | 4 |

Table 2 shows that the initial adhesion of cords coated with a Mn-brass alloy is of the same level (or slightly higher) as that of cords coated with a conventional brass alloy. Particularly noticeable is the fact that the adhesion after humidity ageing is considerably improved when use is made of a CuZnMn-coating.

EXAMPLE 2

The same cords as employed in example 1 were embedded in rubber compound C and vulcanized at 150° C. for 35 minutes. The samples were subjected to a tire cord adhesion test (the pull-out test according to ASTM D 2229-80). Initial adhesion and adhesion after steam ageing at 120° C. were measured. The adhesion results (pull-out force in Newtons) are summarized in table 3.

TABLE 3

Adhesion in Newtons of cords embedded in type C rubber

| Cord types 4 × 0.25 mm | Initial adhesion | Adhesion after steam ageing at 120° C. 12 hours | 24 hours |
|---|---|---|---|
| Conventional coating | | | |
| 0.25 μm brass/65 Cu—35 Zn | 450 | 360 | 250 |
| 0.25 μm brass/71 Cu—29 Zn | 305 | 202 | 140 |
| 0.25 μm brass/61 Cu—39 Zn | 400 | 380 | 260 |
| Mn—brass Alloy coating | | | |
| 0.25 μm/63.5 Cu—2.5 Mn—34 Zn | 438 | 412 | 295 |
| 0.25 μm/68.9 Cu—3.1 Mn—28 Zn | 345 | 275 | 180 |
| 0.25 μm/59.3 Cu—2.9 Mn—37 Zn | 460 | 420 | 288 |

From the adhesion results it follows that adhesion degradation by steam ageing is clearly slowed down when cords coated with a Mn-brass alloy coating were used.

In a second series of tests, 4×0.25 cords were plated with different Mn-brass alloys and compared to conventional brassed cords. The cords were embedded in rubber B and after vulcanization (145° C.-40 minutes) adhesion loss (as a percentage of initial adhesion) was been determined as a result of humidity ageing. The test data are summarized in table 4.

TABLE 4

Adhesion loss (%) after humidity ageing

| Cords 4 × 0.25 mm | Adhesion loss - Humidity ageing: 70° C. - 95% relative humidity 7 days | 21 days |
|---|---|---|
| Brass coating (0.25 μm) | | |
| 62 Cu—38 Zn | 15 | 39 |
| 71 Cu—29 Zn | 28 | 54 |
| Mn—brass alloy coating (0.25 μm) | | |
| 60.5 Cu—39 Zn—0.5 Mn | 9 | 17 |
| 60.2 Cu—36.4 Zn—3.2 Mn | 6 | 19 |
| 59.9 Cu—33.5 Zn—6.9 Mn | 12 | 25 |
| 70.7 Cu—29.1 Zn—0.2 Mn | 16 | 31 |
| 69 Cu—28.3 Zn—2.7 Mn | 13 | 27 |
| 68 Cu—21.6 Zn—10.4 Mn | 21 | 35 |

From the results it follows that, as compared with prior art brassed cords, the Mn-alloy coating displays a remarkable capability of retarding adhesion degradation in conditions of heat and humidity.

The surprisingly favourable effect of manganese has been noticed when coated cords according to this invention are used in the presence of different rubber compounds, subjected to humidity ageing conditions of varying severity. Also initial adhesion remains very good. We belive the unexpected beneficial influence of Mn-brass adhesion coatings on bond properties is to be attributed to its particular effect on sulphur mobility and the sulfidation reaction, either by avoiding further detrimental $Cu_2S$-formation, by avoiding sulphur diffusion into the brass, or by avoiding dezincification of the brass surface.

Ageing tests show that conventional brass coatings remain too reactive towards sulphur and polysulphidic bonds, since the adhesion reaction, involving the formation of bonds between copper in the brass and sulphur in the rubber, is continued beyond the optimum level. In humidity ageing conditions, brass reactivity and sulphur mobility cause overcuring and precipitation of harmful reaction products resulting in Cu-sulfide interface layers which are too brittle and which leads to accelerated bond degradation. In Mn-brass sulphur mobility is slowed down, thereby retarding the ageing reactions.

In consequence, it can be argued that the presence of manganese as a ternary alloying element in brass should, in principle, also be advantageous for high-temperature vulcanization. Because high-temperature curing involves a much shorter cycle than in conventional vulcanizing, it presents obvious manufacturing benefits. It has been experienced, however, that prior art brass coated cords are less suitable for this purpose, given the bond deterioration observed at elevated curing temperatures.

In the following example the adhesion behaviour of cords coated with a ternary Mn-brass alloy was investigated in high-temperature curing conditions and compared with common brassed cords. The cords (4×0.25 mm) were encased in type D rubber and vulcanized at 170° C. for 10 minutes. Adhesive bond strength was determined by means of a cord pull-out test. The results are given below.

TABLE 5

Adhesion force (in Newtons) of 4 × 0.25 mm cords vulcanized with type D rubber (curing at 170° C. - 10 minutes).

| Specimen type | Initial adhesion | Steam aged adhesion (16 hrs at 120° C.) |
|---|---|---|
| Conventional brass coating | | |
| 61.2 Cu—38.8 Zn (0.25 μm) | 371 | 304 |
| 66 Cu—34 Zn (0.19 μm) | 380 | 311 |
| 72 Cu—28 Zn (0.25 μm) | 368 | 156 |
| Mn—brass Alloy coating | | |
| 60.3 Cu—37 Zn—2.7 Mn | 460 | 408 |
| 64.4 Cu—33.1-2.5 Mn | 435 | 415 |
| 70 Cu—27 Zn—3 Mn | 403 | 280 |

Table 5 shows a clearly more favourable initial adhesion for the Mn-brass coatings which moreover possess a considerably improved adhesion retention after steam ageing of the high-temperature cured cords.

Within the scope of the present invention various modifications may be introduced with respect to coating deposition techniques, alloy formation by thermodifffusion and sequence of processing steps.

It should be added that by copper-zinc-manganese alloys are to be understood here as one- or multiphase alloys, ranging from essentially uniform solid solutions to heterogeneous alloy mixtures containing Mn-rich precipitates. Depending on the manufacturing procedure, the MN-brass alloy coatings of this invention may also display a Mn-concentration gradient, such as e.g. alloy coatings with a higher than average Mn-content on their surface.

It will be apparent to those skilled in the art that elongated steel elements other than round wire materials, for instance thin steel strips, tapes and shaped wire products, are also possible substrates for applying a Mn-brass coating.

We claim:

1. A reinforcing element for vulcanized rubber articles, comprising:

(a) a steel reinforcing element; and, (b) a thermodiffused alloy coating said element for increasing the adherence with a rubber article, said alloy consisting of from about 59.3% to about 70.7% copper, from about 0.2% to about 10.4% manganese and with the balance being zinc.

2. A steel element according to claim 1 wherein said alloy coating includes from about 0.2 to about 6% of manganese.

3. A steel element according to claim 1 wherein the manganese is homogenously distributed in said alloy coating and said coating includes from about 0.2 to about 10% of managanese.

4. A steel element according to claim 1 wherein the manganese is essentially concentrated in an outer surface layer of said alloy coating and said coating includes no more than about 5% manganese.

5. A steel element according to claim 1 wherein said coating has a thickness of from about 0.05 to about 0.5 μm.

6. A steel element according to claim 1 wherein said element is a steel wire with a diameter of from about 0.05 to about 2 mm.

7. A rubber adherent steel wire according to claim 6 wherein said wire has a diameter of from about 0.1 to about 0.5 mm and a tensile strength of at least 2500 $N/mm^2$.

8. A steel wire according to claim 7 wherein the ternary Cu-Zn-Mn coating is a diffusion coating with a thickness of from about 0.08 to about 0.40 μm.

9. A steel cord incorporating a plurality of wires as claimed in claim 7.

10. A rubber article including a steel reinforcing element according to claim 1.

11. A vehicle tire including a steel reinforcing element according to claim 9.

12. A steel cord incorporating a plurality of wires as defined in claim 8.

13. The element of claim 1, wherein:

(a) said alloy consisting of from about 62% to about 68% copper, from about 1% to about 4% Mn and with the balance consisting of zinc.

14. The element of claim 1, wherein:

(a) said alloy having a thickness of from between about 0.12 μm to about 0.30 μm.

15. The element of claim 14, wherein:

(a) said elements including a wire having a diameter of from about 0.05 mm to about 2.0 mm.

16. A reinforced vehicle tire, comprising:

(a) a rubber tire body; and, (b) a steel reinforcing element positioned within said body and said element having an alloy coating consisting of from about 59.3% to about 70.7% copper, from about 0.2% to about 10.4% manganese and with the balance being zinc.

17. The tire of claim 16, wherein:

(a) said element including a plurality of wires, each of said wires having a diameter of from about 0.1 to about 0.5 mm and a tensile strength of at least 2500 $N/mm^2$ and said coating having a thickness of from about 0.08 to about 0.40 μm.

18. The tire of claim 17, wherein:

(a) the manganese of said coating being essentially concentrated in an outer surface layer thereof and said coating including from about 0.02 to about 5% manganese.

19. The tire of claim 17, wherein:

(a) the manganese of said coating being homogeneously distributed throughout said coating and said coating includes from about 0.2% to about 1% manganese.

* * * * *